US008746918B1

(12) United States Patent
Rubino

(10) Patent No.: US 8,746,918 B1
(45) **Date of Patent: *Jun. 10, 2014**

(54) MULTI-FUNCTION TELESCOPIC FLASHLIGHT WITH UNIVERSALLY-MOUNTED PIVOTAL MIRROR

(71) Applicant: Michael Rubino, Chicago, IL (US)

(72) Inventor: Michael Rubino, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/855,954

(22) Filed: Apr. 3, 2013

Related U.S. Application Data

(63) Continuation of application No. 13/346,836, filed on Jan. 10, 2012.

(51) Int. Cl.

| | |
|---|---|
| ***F21V 33/00*** | (2006.01) |
| ***F21V 17/02*** | (2006.01) |
| ***F21V 17/10*** | (2006.01) |
| ***F21L 4/04*** | (2006.01) |
| *F21V 21/096* | (2006.01) |

(52) U.S. Cl.

CPC ..... *F21V 17/02* (2013.01); *F21V 17/105* (2013.01); *F21V 33/00* (2013.01); *F21L 4/04* (2013.01); *F21V 21/096* (2013.01); *Y10S 359/903* (2013.01)

USPC ..... 362/139; 362/138; 362/142; 362/282; 362/198; 362/457; 359/221.2; 359/223.1; 359/871; 359/872; 359/903

(58) Field of Classification Search

USPC ..... 362/198, 162, 189, 120, 138–139, 142, 362/197, 398, 457; 359/221.2, 223.1, 359/226.1–226.2, 212.2, 871, 872, 903

See application file for complete search history.

(56) References Cited

U.S. PATENT DOCUMENTS

| | | | | |
|---|---|---|---|---|
| 3,924,115 | A | 12/1975 | Hampton et al. | |
| 4,225,907 | A * | 9/1980 | Erdell | 362/255 |
| 5,023,761 | A * | 6/1991 | de Lange | 362/120 |
| 5,176,438 | A | 1/1993 | Fisherman | |
| 5,381,319 | A | 1/1995 | Shiao | |
| 5,647,623 | A | 7/1997 | Shiao | |
| 5,707,137 | A | 1/1998 | Hon | |
| 5,716,121 | A | 2/1998 | Dubois | |
| 5,915,825 | A * | 6/1999 | Weister | 362/139 |
| 5,951,142 | A | 9/1999 | Wang et al. | |
| 6,007,214 | A * | 12/1999 | Shiao | 362/120 |
| 6,210,009 | B1 | 4/2001 | Daly | |
| 7,510,295 | B2 * | 3/2009 | Shih | 362/119 |
| 2003/0007346 | A1 | 1/2003 | Cooper et al. | |
| 2004/0090776 | A1 | 5/2004 | Yang | |
| 2005/0201085 | A1 | 9/2005 | Aikawa et al. | |

OTHER PUBLICATIONS

"Rite-Site Non-Inverted Image Inspection Mirror", product brochure by Sensible Products, Inc.

* cited by examiner

*Primary Examiner* — Diane Lee
*Assistant Examiner* — Kenny C Sokolowski
(74) *Attorney, Agent, or Firm* — Milton Gerstein

(57) ABSTRACT

A telescopic flashlight that includes a universally adjustable mirror unit for reflecting the light of the lighting unit over a universal range, which mirror unit is readily and easily attached and detached from the distal end of the flashlight apparatus via a metallic mounting collar that is magnetically retained by means of an annular magnet affixed to the distal end of the apparatus, which mounting collar itself is rotatable relative to the distal end of the flashlight apparatus in order to provide two of the three degrees of freedom on motion of the mirror proper.

11 Claims, 4 Drawing Sheets

MULTI-FUNCTION TELESCOPIC FLASHLIGHT WITH UNIVERSALLY-MOUNTED PIVOTAL MIRROR

CROSS REFERENCE TO RELATED APPLICATION

This is a continuation application of application Ser. No. 13/346,836, filed on Jan. 10, 2012;

BACKGROUND OF THE INVENTION

The present invention is directed to a telescopic flashlight, and, in particular, to such a telescopic flashlight disclosed in U.S. Pat. No. 7,510,295, which patent is incorporated by reference herein, and which discloses a telescopic, collapsing flashlight having an extensible stem with a retractable and bendable flexible member, which allows for hard-to-reach areas and locations to be illuminated. The illuminating structure or device of the flashlight is attached to, and located at, the distal end of the flexible member, and includes a power button. At the distal end of the illuminating body, there is also provided a magnetic collar for use in attracting and holding a metal object during use of the flashlight.

In U.S. Pat. No. 5,951,142 there is disclosed an adjustable illuminating apparatus having an adjustable lighting unit, and which is also provided with an adjustable reflecting mirror unit mounted at the end of the apparatus, with the light from the lighting unit impinging on the mirror and being reflected thereby. The reflecting mirror unit is mounted to the end of the apparatus via mating threaded parts.

In published U.S. Application Number US2005/0201085, there is disclosed a telescopic flashlight apparatus having at one end thereof a pivotal mirror unit for reflecting the light emanating from the lighting unit to various locations. This mirror unit is cumbersome, and difficult to attach and remove.

SUMMARY OF THE INVENTION

It is the primary objective of the present invention to provide a telescopic, collapsible flashlight apparatus that includes a universally adjustable inspection mirror unit for reflecting the light of the lighting unit over a universal range, which mirror unit is readily and easily attached and detached from the distal end of the flashlight apparatus via a mounting collar having an annular metallic mounting ring that is magnetically retained by means of an annular magnet affixed to the distal end of the apparatus where the lighting or illuminating device is located, which mounting collar itself is rotatable relative to the distal end of the flashlight apparatus in order to provide two degrees of freedom of rotational motion of the mirror proper.

It is also the primary objective of the present invention to provide such a telescopic flashlight apparatus with a distal, adjustable mirror unit that is itself removably detachable, such that the mirror proper may be attached and re-attached to the mounting collar at will, so that when the mirror proper is not needed for directing the light from the lighting unit to hard-to-see or get-at places or locations, it may be removed from the metallic mounting collar, so that it does not interfere with the normal and average use of the flashlight apparatus.

BRIEF DESCRIPTION OF THE DRAWING

The invention will be more readily understood with reference to the accompanying drawings, wherein.

DETAILED DESCRIPTION OF THE INVENTION

Figure 1:
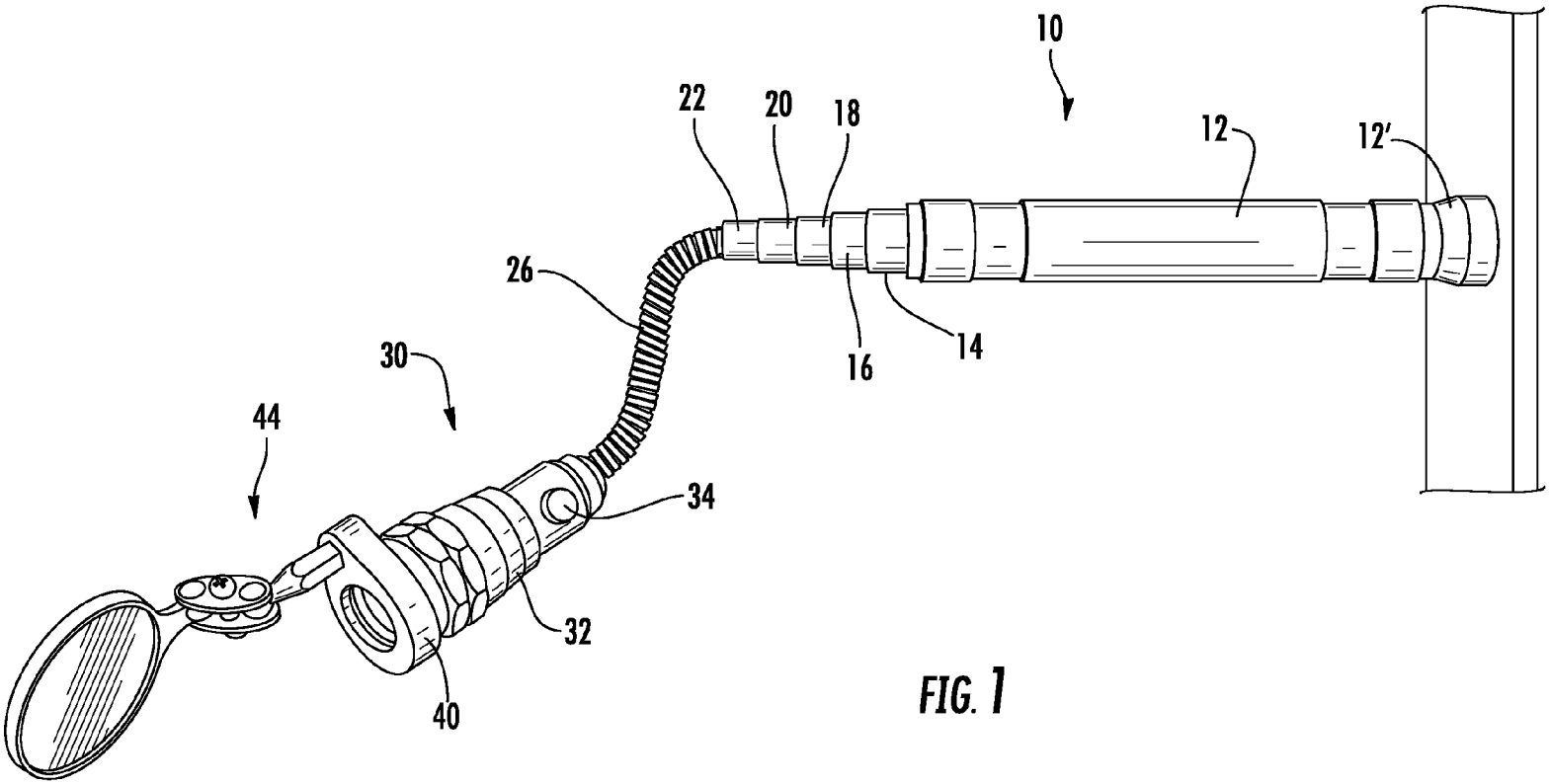
FIG. 1 is a perspective view of the telescopic flashlight device with universally-adjustable mirror unit of the invention.
Figure 2:
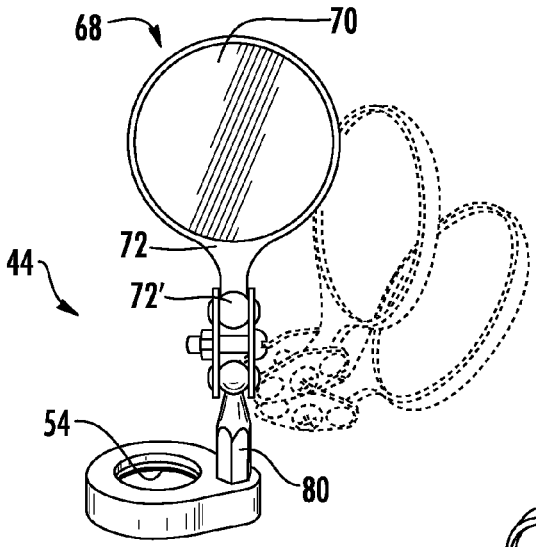
FIG. 2 is a perspective view of the universally-adjustable mirror unit of the flashlight device of FIG. 1 and showing various positions it may be assume in a first plane.
Figure 3:
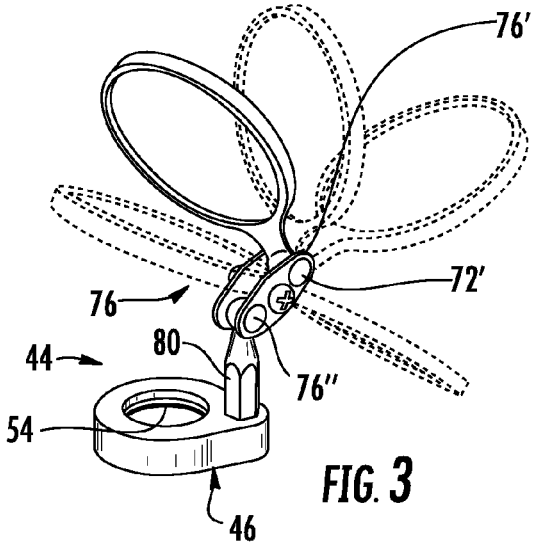
FIG. 3 is a perspective view similar to FIG. 3 but showing the universally-adjustable mirror unit pivoted to various positions via a first pivot in a second plane.
Figure 4:
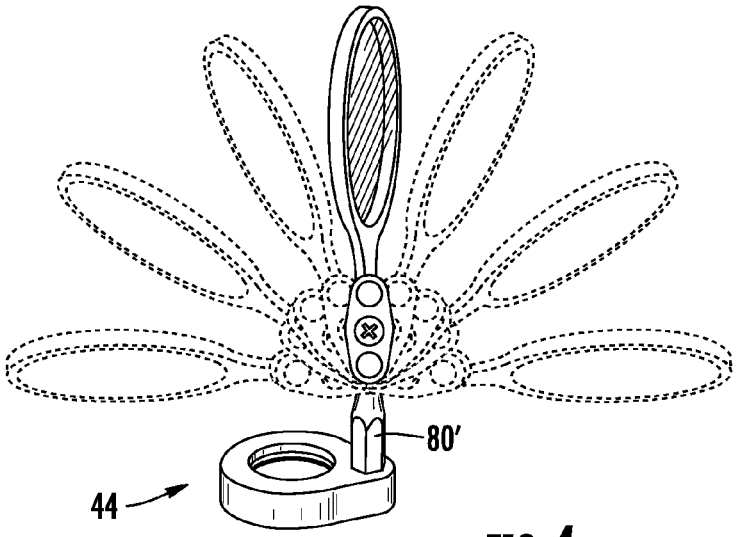
FIG. 4 is a perspective view similar to FIG. 3 but showing the universally-adjustable mirror unit pivoted to various positions via a second pivot in the second plane.

Referring now to the drawings in greater detail, the telescopic flashlight device with universally-adjustable mirror unit is indicated generally by reference numeral 10. The basic telescopic flashlight is that disclosed in U.S. Pat. No. 7,510,295, which patent is incorporated by reference herein. The telescopic, collapsing flashlight 10 includes a main, hollow, cylindrical handle, body portion or casing 12, used for gripping the flashlight, and in which is received a series of collapsing, hollow, telescoping elements or sections 14, 16, 18, 20, and 22. Each telescopic element 14, 16, 18, 20, and 22 is collapsible into the immediate-adjacent element closer to the main body portion or housing 12, in the manner depicted in FIG. 1, for storage, and for removal therefrom for expansion and use. The degree to which the telescoping elements are pulled out is variable so that the flashlight may be used in all environments. The end of the main body portion is provided with a enlarged head or section 12', to which is secured a magnet for attracting and holding metal objects.

Figure 5:
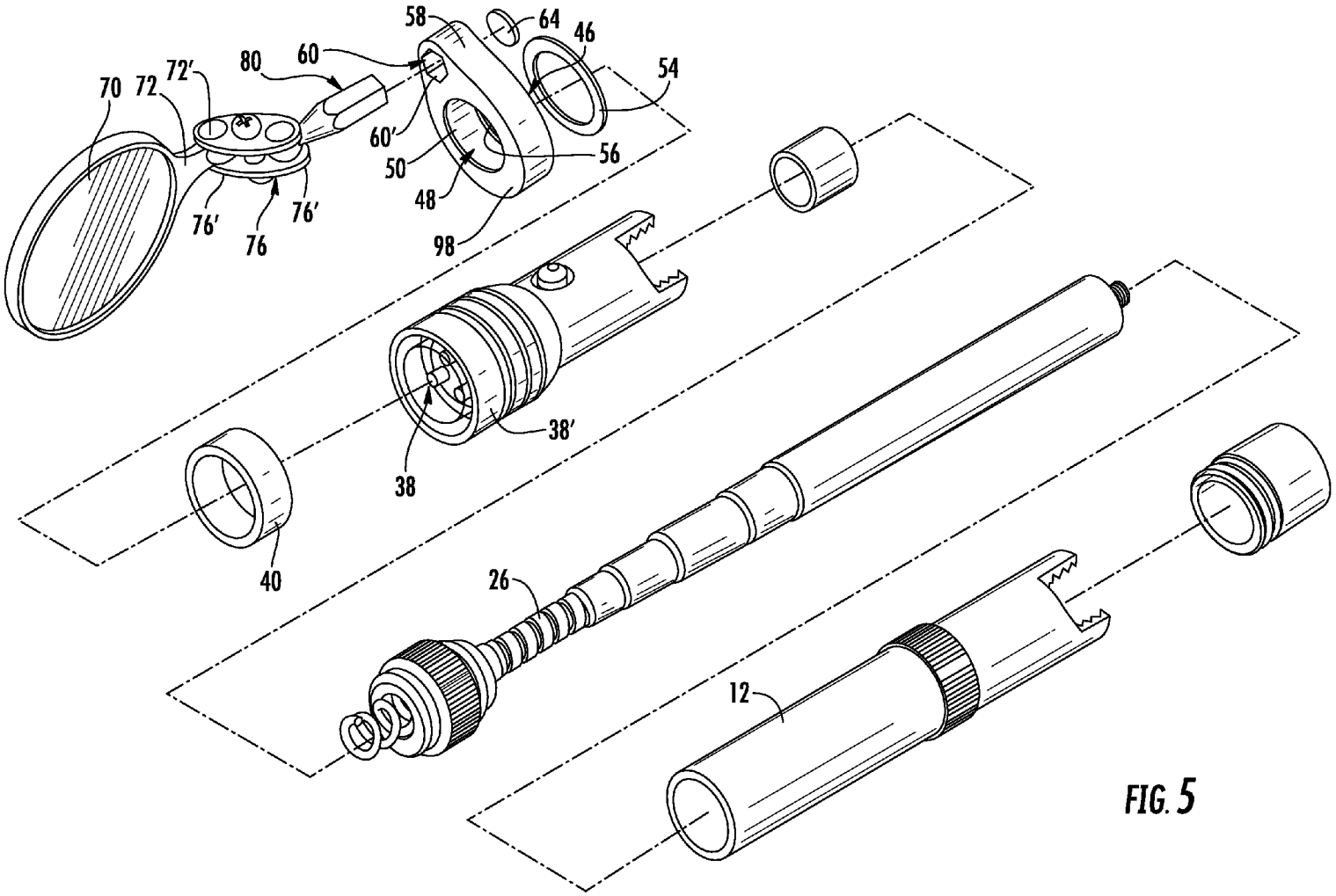
FIG. 5 is an assembly view, in perspective, showing the telescopic flashlight device with universally-adjustable mirror unit of FIG. 1.

At the end of the telescopic section 22 there is provided a flexible, bendable member or section 26 which is collapsible into the telescopic section 22, and to the end of which is attached or mounted an illuminating or lighting unit or device 30. The illuminating device 30 comprises a hollow main housing 32 serving as a battery or power-cell compartment, a push-button switch 34, or the equivalent thereof, and a removable bulb-fixture 38 (FIG. 5) containing one or more halogen lighting bulbs or LCD's. The distal end 38' of the removable bulb-fixture 38 also mounts a forwardly-facing, annular magnet, such as magnet-ring 40, by which objects may be picked up and held.

The annular magnet 40 is used to removably, temporarily and rotatably mount a universally-pivotal reflection mirror unit 44. The universally-pivotal reflection mirror unit 44 is comprised of a removable mounting collar or annular ring-element 46, defining an inner, circular main portion 48 defining an exteriorly-located or outer annular surface section, which is substantially circular in shape that defines an outer or outwardly-facing opening 50. To the interior-facing portion of the exteriorly-located or outer annular surface section is mounted an annular element or ring 54 made of magnetic material, such as ferrous metal, which is attracted to, and held by the, annular magnet 40. The inner or inwardly-facing opening 56 of the annular ring-element 46 has a diameter slightly larger than the diameter of the distal end of the removable bulb-fixture 38, so that the annular ring-element 46 may be telescopingly mounted thereover, and held removably in place thereat, by means of the annular magnet 40 magnetically retaining the annular ring-element 46 via the metallic ring or annular element 54, whereby the entire universally-pivotal reflection mirror unit 44 is rotatable in a first degree of rotational motion about the end of the flashlight. It is noted that the central or inner opening of the annular ring-element 46 has a diameter less than the diameter of the distal end of the removable bulb-fixture 38, whereby the interior-facing portion of the metallic annular ring 54 abuts against the annular end-surface distal end 38' of the removable bulb-fixture 38 in face-to-face contact with the annular magnet 40 to allow for the mounting thereto. The material from which the annular ring element 46 is made is preferably plastic providing a low coefficient of friction, which readily allows the rotation thereof about the distal end 38' of the illuminating device 30, which is also made of plastic having a low coefficient of friction. The facing and contacting surfaces of the annular magnet 40 and the metallic annular ring 54 also offer a low coefficient of friction, whereby no obstruction to the rotation of the mounting annular ring-element 46 exists. Alternatively, the annular ring 46 may be made entirely of a low-coefficient-of-friction magnetic material, such as ferrous metal, which obviates the need for the metallic annular ring 54.

Figure 6:
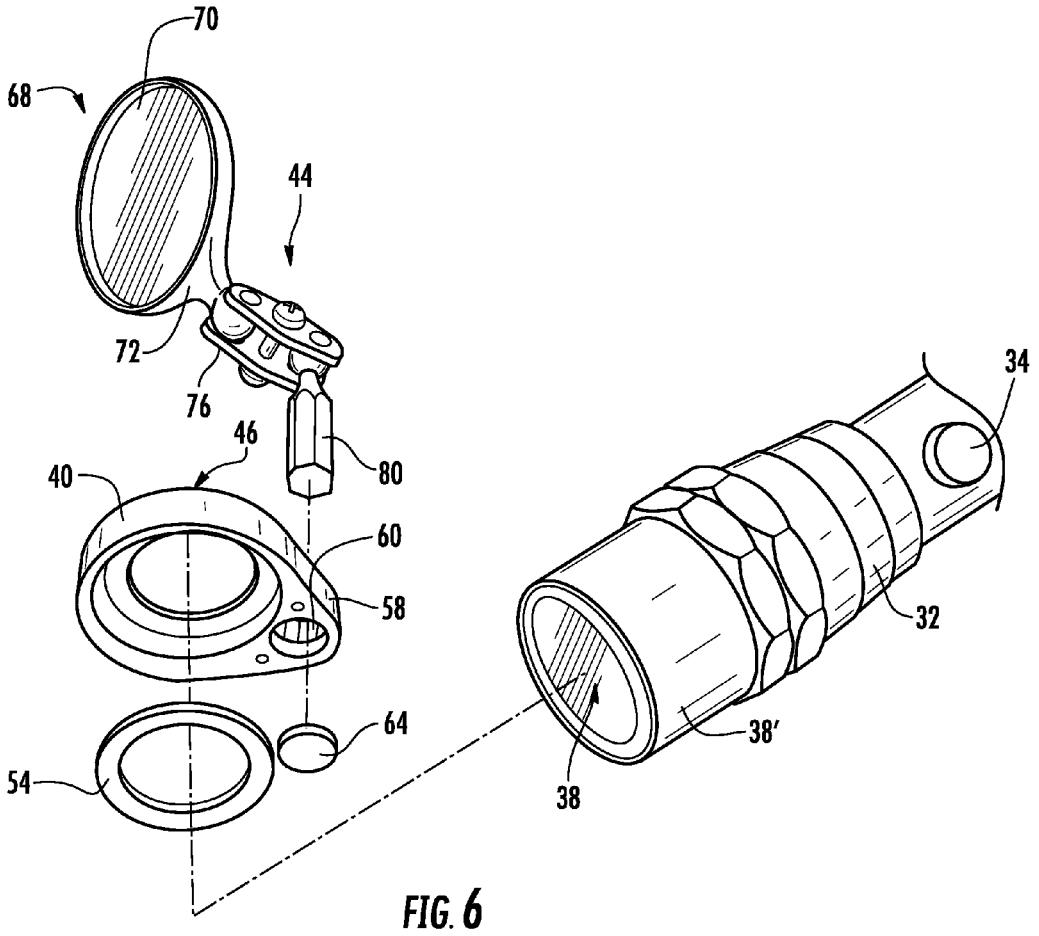
FIG. 6 is an assembly view of the universally-adjustable mirror unit of the invention.
Figure 7:
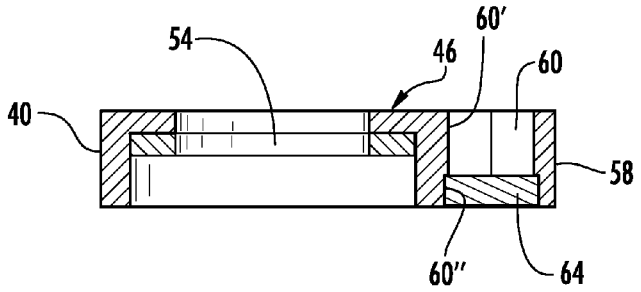
FIG. 7 is a transverse cross-sectional view of the assembled universally-adjustable mirror unit.

The removable mounting collar or annular ring-element 46 is also provided with an eccentric or protruding section 58 defining a through-opening or hole 60. The opening 60 has a first outer portion 60' that is preferably hexagonal in shape for part of the depth of the opening 60, and a second inner portion 60" that is circular in shape for the remainder of the depth thereof. Mounted in the circular portion 60" is a circularly-shaped magnetic rod or post-element 64, as best seen in FIGS. 6 and 7.

The universally-pivotal reflection mirror unit 44 also consists of the main mirror-portion 68, which contains the mirror-element proper 70, which is preferably circular in shape. The circular-shaped mirror 70 has a mounting eccentric or ear 72 defining a bottom pivot shaft or post 72' that is pivotally mounted at one end 76' of a mounting bracket 76, in a conventional manner; the mirror unit is allowed a second degree of rotational motion different from the first degree of rotational motion provided by the annular ring-element 46. To the other end 76" of the mounting bracket 76 is pivotally mounted a metallic mounting pin or shaft 80, made of ferrous metal or the like, which defines a hexagonally-shaped main shaft portion 80' which is partially receivable in the first, outer hexagonally-shaped portion 60' of the opening 60, whereby the metallic mounting pin or shaft 80, and thus the mirror-element proper 70, are removably mounted to the mounting collar or annular ring-element 46, and where the mirror unit is also allowed additional degrees of rotational motion via the spherical or ball joint at the upper end of the pin 80. Thus, the universally-pivotal reflection mirror unit 44 is removable from the illuminating or lighting unit or device 30 in two ways or sections: The first by means of the metallic collar, or an annular element or ring 46, by which the entire mirror unit 44 is removable, and the second by means of the metallic mounting pin or shaft 80, by which part of the mirror unit 44 is removable, whereby differently-shaped or sized mirrors 70 may be mounted to the illuminating device. For example, a prism mirror, disclosed in U.S. Pat. No. 6,210,009, may be attached to the illuminating apparatus, which prism mirror displays a non-inverted image of the object or objects, being viewed in the proper sense and handedness.

While the universally-pivotal reflection mirror unit 44 has been disclosed for use and removable attachment to a telescopic, collapsing flashlight, it may be used in all types of flashlights incorporating an annular magnet at the distal end of the lighting unit itself, or at the distal of another section of the flashlight. Moreover, the universally-pivotal reflection mirror unit 44 may incorporated into other lighting devices not considered to be a flashlight, as long as it incorporates a magnetic ring or magnetic, in a manner equivalent to the mounting of the universally-pivotal reflection mirror unit 44.

It is also noted that instead of the forwardly-facing annular magnet 40 located on the front surface of the illuminating device 30, a collar-magnet that circumferentially surrounds the end 38' thereof may be used, in which case the annular element or ring 46 would be located or mounted to interior annular rim-surface thereof for face-to-face contact with the collar-magnet.

While a specific embodiment of the invention has been shown and described, it is to be understood that numerous changes and modifications may be made therein without departing from the scope and spirit of the invention.

What is claimed is:

1. In a collapsing, telescoping flashlight comprising a main, hollow, handle portion, and a plurality of telescoping sections collapsible one in another and into said main, hollow, handle portion, at least one of the telescoping sections being a flexible and bendable section and defining a distal end, and an illuminating device mounted to said distal end of said flexible and bendable section, said illuminating device having an outer end portion thereof distant from said telescoping sections, and a first magnet mounted at said outer end portion of said illuminating device, the improvement comprising:

a universally-adjustable mirror apparatus removably attached to said first magnet mounted at said outer end portion of said illuminating device for rotational movement relative to said outer end portion of said illuminating device about an axis defined by a light emitting axis of the flashlight for providing one degree of rotational motion to said universally-adjustable mirror apparatus;

said mirror apparatus comprising a mounting bracket comprising an annular collar element defining a first inner opening for positioning circumferentially about said outer end portion of said illuminating device, a second, smaller outer opening defining an interior annular rim, and a mirror device removably attachable to said mounting bracket, said mounting bracket mounted for rotatable movement about said outer end portion of said illuminating device to provide said one degree of rotational motion;

said mirror device comprising a mirror; a pivotal mounting element having a first end for mounting said mirror for pivotal motion for a second degree of rotational motion in a plane perpendicular to a plane containing said one degree of rotational motion, and a second end; and a mounting pin made of magnetic material and having a first end pivotally mounted in said second end of said pivotal mounting element for providing at least one additional degree of rotational motion, and a second end;

said mounting bracket also comprising a hole, and a second magnet at least partially mounted in said hole;

said second end of said mounting pin being detachably received in said hole of said mounting bracket and held therein by said second magnet mounted in said hole, whereby said mounting pin is removably held in place by said second magnet, and whereby parts of said mirror apparatus are removable from said illuminating device in two distinct ways;

said mounting bracket comprising an annular mounting ring comprising magnetic material for mounting to the interior surface of said interior annular rim, whereby said annular mounting ring is attracted to and held by said first magnet in order to provide said one degree of rotational motion about the axis defined by the light emitting axis of the flashlight.

2. The collapsing, telescoping flashlight according to claim 1, wherein said hole comprises a first exterior circular section for receiving and mounting therein said second magnet, and a second interior section of non-circular cross section for receiving said second end of said mounting pin therein; said second end of said mounting pin having the same cross-sectional shape as said second section of said opening.

3. The collapsing, telescoping flashlight according to claim 2, wherein said mounting bracket comprises an eccentric section projecting from a portion of said annular collar element, said hole of said mounting bracket being located in said eccentric section.

4. The collapsing, telescoping flashlight according to claim 2, wherein said non-circular shape of said second section is hexagonal.

5. The collapsing, telescoping flashlight according to claim 1, wherein said mounting bracket comprises an eccentric section projecting from a portion of said annular collar element, said hole of said mounting bracket being located in said eccentric section.

6. In a collapsing, telescoping flashlight comprising a main, hollow, handle portion, and a plurality of telescoping sections collapsible one in another and into said main, hollow, handle portion, at least one of the telescoping sections being a flexible and bendable section and defining a distal end, and an illuminating device mounted to said distal end of said flexible and bendable section, said illuminating device having an outer end portion thereof distant from said telescoping sections and defining a central longitudinal axis thereof, and a magnet mounted at said outer end portion of said illuminating device, the improvement comprising:

an adjustable mirror apparatus removably attached to said magnet mounted at said outer end portion of said illuminating device for rotational movement relative to said outer end portion of said illuminating device about said central longitudinal axis for providing one degree of rotational motion to said adjustable mirror apparatus;

said mirror apparatus comprising a mounting bracket comprising an annular collar element defining a first inner opening for positioning circumferentially about said outer end portion of said illuminating device, a second, smaller outer opening defining an interior annular rim, and a mirror device attached to said mounting bracket, said mounting bracket mounted for rotatable movement about said outer end portion of said illuminating device to provide said one degree of rotational motion;

said mirror device comprising a mirror; a pivotal mounting element having a first end for mounting said mirror for pivotal motion for a second degree of rotational motion in a plane perpendicular to a plane containing said one degree of rotational motion, and a second end; and a mounting pin having a first end pivotally mounted in said second end of said pivotal mounting element for providing at least one additional degree of rotational motion to said mirror, and a second end;

said mounting bracket comprising an annular mounting ring comprising magnetic material for mounting to the interior surface of said interior annular rim, whereby said annular mounting ring is attracted to and held by said magnet in order to provide said one degree of rotational motion about the central longitudinal axis.

7. The illuminating apparatus according to claim 6, wherein said mounting bracket comprises a hole, and another magnet partially received in said hole; said second end of said mounting pin being detachably received in said hole of said mounting bracket in close juxtaposition to said another magnet mounted in said hole, whereby said mounting pin is removably held in place by said another magnet, and whereby parts of said mirror apparatus are removable from said illuminating device in two distinct ways.

8. The illuminating apparatus according to claim 7, wherein said hole comprises a first circular section for receiving and mounting therein said another magnet, and a second section of non-circular cross section for receiving said second end of said mounting pin therein; said second end of said mounting pin having the same cross-sectional shape as said second section of said opening.

9. The illuminating apparatus according to claim 8, wherein said non-circular shape of said second section is hexagonal.

10. The illuminating apparatus according to claim 7, wherein said mounting bracket comprises an eccentric section projecting from a portion of said annular collar element, said hole of said mounting bracket being located in said eccentric section.

11. In a flashlight comprising a main housing having an outer end portion and defining a central longitudinal axis thereof, an illuminating device mounted in said outer end portion, a handle portion, and an annular magnet mounted at said outer end portion of said main body portion, the improvement comprising:

an adjustable mirror apparatus removably attached to said annular magnet mounted at said outer end portion for rotational movement relative to said outer end portion about said central longitudinal axis for providing one degree of rotational motion to said adjustable mirror apparatus;

said mirror apparatus comprising a mounting bracket comprising an annular collar element defining a first inner opening for positioning circumferentially about said outer end portion, a second, smaller outer opening defining an interior annular rim, and a mirror device attached to said mounting bracket, said mounting bracket mounted for rotatable movement about said outer end portion to provide said one degree of rotational motion;

said mirror device comprising a mirror; a pivotal mounting element having a first end for mounting said mirror for pivotal motion for a second degree of rotational motion in a plane perpendicular to a plane containing said one degree of rotational motion, and a second end; and a mounting pin having an end pivotally mounted in said second end of said pivotal mounting element for providing at least one additional degree of rotational motion to said mirror;

said mounting bracket comprising an annular mounting ring comprising magnetic material for mounting to the interior surface of said interior annular rim, whereby said annular mounting ring is attracted to and held by said annular magnet in order to provide said one degree of rotational motion about the central longitudinal axis.

* * * * *